US005289711A

United States Patent [19]

Spiegel

[11] Patent Number: 5,289,711

[45] Date of Patent: Mar. 1, 1994

[54] APPARATUS FOR SPREADING STEEL STRUCTURES

[76] Inventor: Leo J. Spiegel, 61 Princeton St., Williston Park, N.Y. 11596

[21] Appl. No.: 893,603

[22] Filed: Jun. 3, 1992

Related U.S. Application Data

[63] Continuation of Ser. No. 700,591, May 15, 1991, abandoned.

[51] Int. Cl.[5] ..... B21D 1/12

[52] U.S. Cl. ..... 72/392; 72/705

[58] Field of Search ..... 72/392, 705, 447, 457; 254/134, DIG. 1

[56] References Cited

U.S. PATENT DOCUMENTS

| | | | |
|---|---|---|---|
| 2,151,063 | 3/1939 | Weaver | 72/705 |
| 2,194,991 | 3/1940 | Voges | 72/705 |
| 2,717,020 | 9/1955 | Dobias | 72/705 |
| 3,302,927 | 2/1967 | Gray | 254/134 |
| 3,416,353 | 12/1968 | Hopkins | 72/705 |
| 4,783,053 | 11/1988 | Yirmiyahu et al. | 72/705 |
| 4,930,335 | 6/1990 | Ishihara | 72/705 |

*Primary Examiner*—Lowell A. Larson

*Attorney, Agent, or Firm*—Bauer & Schaffer

[57] ABSTRACT

A telescoping base support having an elongated tube and an elongated slide coaxially and slideably nested therein is provided to form a secure support for a power ram used to deflect the entrapping structure. Ideally, the power ram is pivotably mounted to a carrige which is slideably disposed about the tube of the base support and longitudinally positionable thereon.

9 Claims, 2 Drawing Sheets 10
14
16
18
20
22
24
26
28
30
32
34
36
38
40
42
44
50
52
54
58
60
62
64
66
70
72
A
3
3
0
0

16a
46
48
32a

APPARATUS FOR SPREADING STEEL STRUCTURES

This is a continuation of Ser. No. 700,591, filed May 15, 1991, now abandoned.

FIELD OF THE INVENTION

The present invention relates to appartus for spreading steel structures and similar structural members and, in particular, to apparatus for spreading crushed vehicles in rescue operations.

BACKGROUND OF THE INVENTION

The use of power rams as spreaders of metal structures, particularly in rescuing victims from vehicles, is well known. The typical scenario in such application uses a double-acting hydraulic or pneumatic motor device to extricate automobile occupants trapped therein after a collision. Although vehicle crashes are probably the most common application, the application of these power rams is not so limited as they are also used to provide tremendous force necessary to move structural and heavy items in order to provide a path of egress and enable the retrieval of a person or object confined, for example, in collapsed buildings, mine shaft cave-ins, and other emergencies.

Power rams for rescue purposes are typically simple, straight hydraulic cylinder and piston devices which can expand lengthwise with force on the order of thousands of pounds. Because of the straight configuration of these devices, they must be oriented with one end against a counterstructure with the other end against the steel beam or member to be moved in a directly opposite position. Not only must there physically be a counterstructure, but the counterstructure must be strong enough to support and withstand the force necessary to effect the movement. Quite commonly, such opposite counterstructure either does not exist or is of insufficient strength to support the power ram loads needed to move the structure.

Further, the ram spreaders require cribbing or the placement and stacking of blocks of wood to fabricate a base support against which the ram is placed. Unfortunately, this often makes an inadequate or unsafe base for the ram because the wood blocking is prone to breakage, and the ram may likewise slip from the wood blocks under operational loads. In order to avoid such disadvantage, it is necessary to seat the base of the ram squarely upon the wood blocking in direct opposition to the object being moved. This is quite frequently impossible in collapsed vehicles and in turn severely limits the operating angle at which the ram may be articulated from the base.

Furthermore, in such an operation the selection of wood blocks to use as a base support for the ram is limited to those of a size which can be fit through the openings in the entrapping structure, e.g. an automobile window. Often those pieces which are small enough to fit into the entrapping structure are not large enough to provide a safe supporting structure for the power ram. Accordingly, the prior designs for power ram spreaders leave considerable room for improvement.

It is an object of the present invention to provide a power ram type spreader, which does not require the use of cribbing or the impromptu fabrication of a base support.

It is another object of the present invention to provide a ram type spreader having a configurable base support upon which the power ram can be securely braced during use.

It is still another object of the present invention to provide a ram type spreader having a base support which permits angular articulation of the power ram.

Yet another object of the present invention is to provide a ram type spreader having a longitudinally telescoping base support.

A further object of the present invention is to provide a power ram type spreader having a base support with means for varying and securing the position of the power ram longitudinally thereon.

Other objects and advantages of the present invention will become obvious to those of skill in the art upon contemplation of the disclosure herein.

SUMMARY OF THE INVENTION

According to the present invention, apparatus is provided for spreading apart fixed steel or similar construction components, particularly adapted to spreading crushed and deformed structures during rescue operations. The apparatus comprises a telescoping base support formed of an elongated hollow outer tube and an elongated inner tube slidably located therein. Locking means is provided to fixedly secure the inner tube in a selected position relative to the outer tube so that the length of the base can be adjustably fixed. A carriage is slidably disposed about the outer tube to which a hydraulic or pneumatic ram can be attached. The carriage is longitudinally slideable along the base and has means for locking it in selected position.

Preferably, the carriage is provided with a clevis having a spaced pair of ears extending therefrom, each of which has a hole. The rear wall of the ram is provided with a tongue having an aperture therethrough so as to be pivotably mounted in the clevis by a removable pin.

It may also be desired to provide a pair of supporting feet slideably over the outer tube and positioned to support the apparatus in hard to brace situations.

Full details of the present invention will seen from the following description of the preferred embodiments and from the accompanying drawings.

DESCRIPTION OF THE INVENTION

While the present invention has application broadly in rescue and non-rescue operations, where it is necessary to spread apart steel or similar structural members, it is particularly beneficial to quickly and easily extricate victims of automobile collisions in which the victims are trapped in the crushed chassis. For the sake of explanation therefore, the invention is described in connection with such rescue operation, although it will be understood that it is not so limited.

Figure 1:
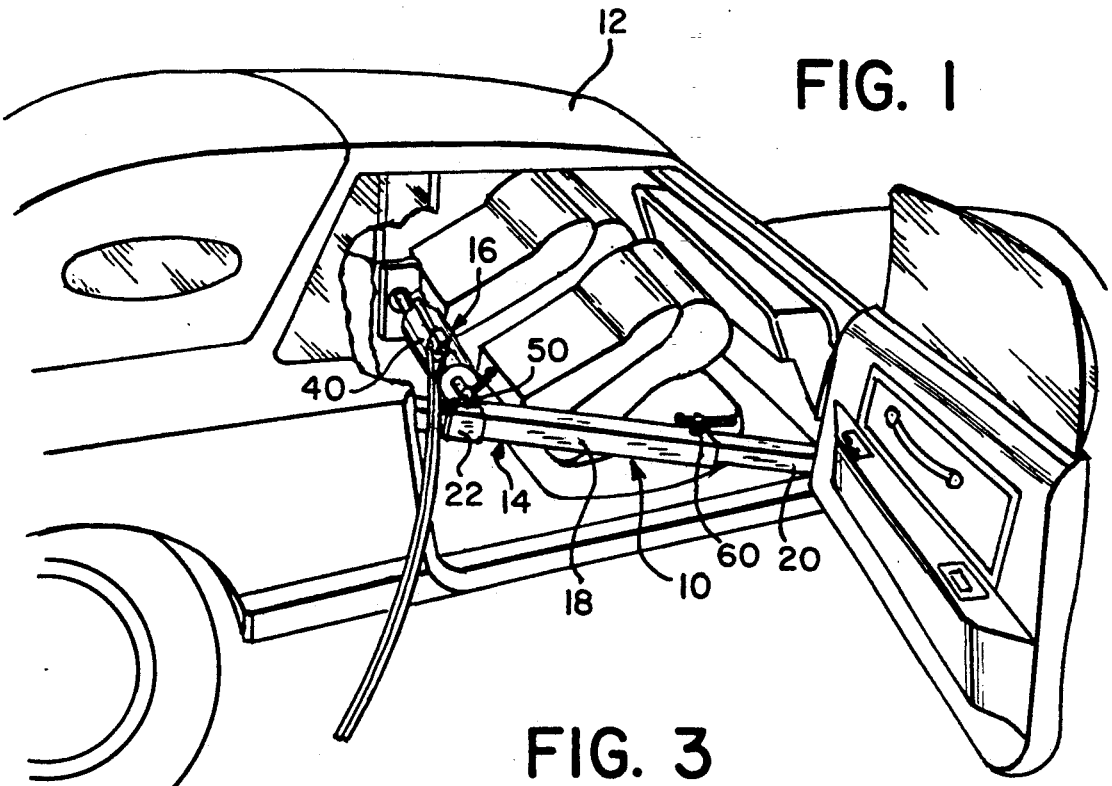
FIG. 1 is a perspective view of the apparatus of the present invention as employed in spreading the sides of a crushed vehicle.

As seen in FIG. 1, the apparatus generally depicted by the numeral 10 is shown in position to expand or distend the sides of automobile 12 crushed laterally inwardly. Broadly, the apparatus comprises an elongated base support, generally depicted by the numeral 14, which is adapted to be braced against the structural members of the vehicle on one side and a ram 16 attached thereto in a generally perpendicular direction braced against the opposite side of the vehicle.

The base support 14 comprises a hollow, elongated outer tube 18 and an elongated inner tube 20 nested concentrically therein so as to be telescopingly adjustable one within the other. Slideable over the outer tube 18 is a carriage 22 having a stub-like body 24 conforming in shape to cross section of the outer tube 18. The outer tube 18, the inner tube 20, and the carriage 22 are all preferably fabricated of square or rectangular steel tubing. These members are so dimensioned that the manner in which they are telescoped one over the other is not critical, yet they may be easily assembled and retain their relative slideability along the longitudinal axis O of the base support 14 in the directions of the double arrow A. Where such fabrication is of closely fitting square tubing, relative rotation or torqueing of these components about the axis O is prevented, and weight is minimized while maintaining sufficient strength for use in adverse situations.

It will, of course, be understood that other cross sectional shapes may be used. For example, channel beams such as U-, I-, or H-beams may also be used. Even round tubing stock may be used if provided with antirotation means such as detents, elongated grooves, or slots.

Figure 3:
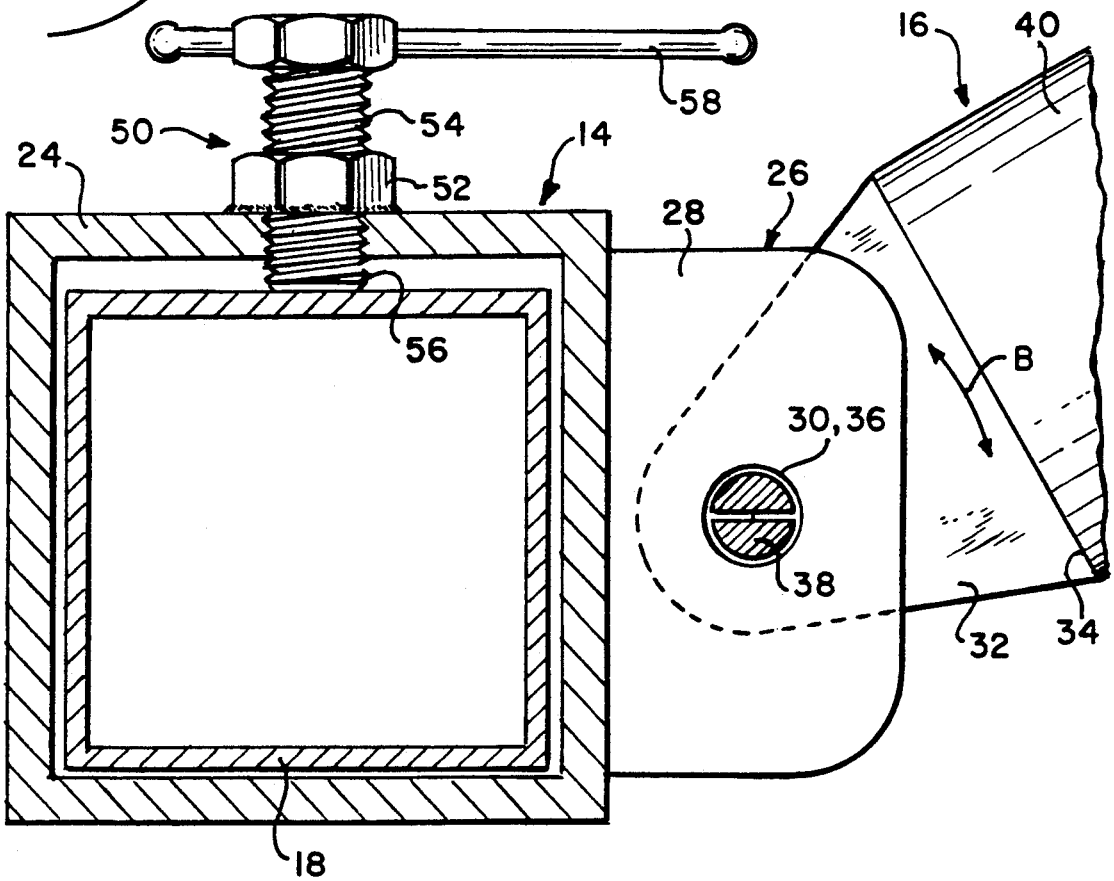
FIG. 3 is a sectional view taken along line III—III of FIG. 2.
Figure 2:
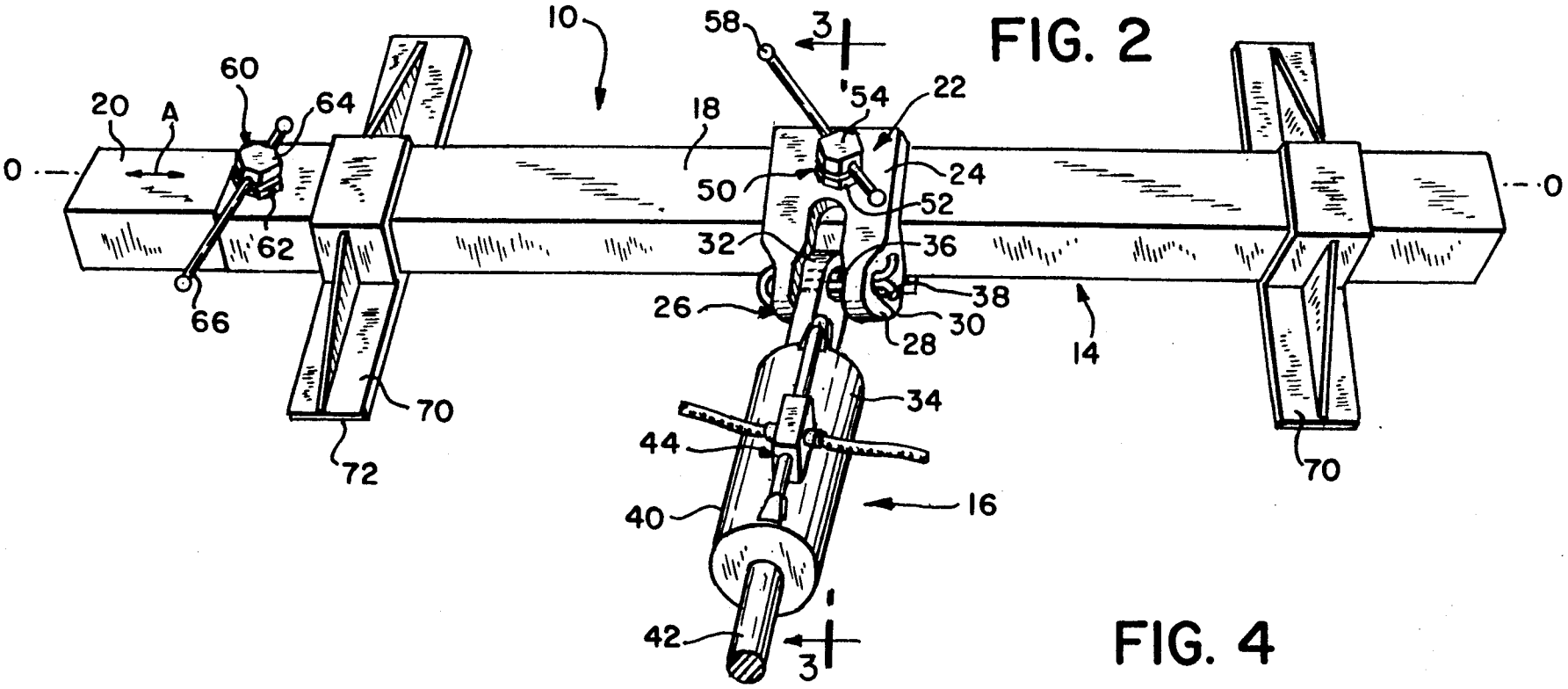
FIG. 2 is a perspective view of the rescue apparatus embodying the instant invention.

The body 24 of the carriage 22 is provided with a clevis 26 by which the ram 16 is pivotally secured. Preferably, the clevis 26 is formed of a pair of flat tab-like ears 28 extending perpendicularly from one side of the carriage 22. Each tab has a hole 30, and both holes are aligned along an axis parallel to the longitudinal axis O. As seen in FIG. 2 the ram 16 is preferably formed with a tongue 32, integral with and extending from its rear wall 34 so as to fit between the ears 28 of the clevis 26. The tongue 32, formed with a hole 36, is held in the clevis 26 by a pin 38 such as a cotter pin, or the like. In this manner, the ram 16 is securely held in attachment to the base support 14, yet is pivotal in a plane transverse to the axis O of the base support and with respect thereto so as to enable the opposite end to be elevated or depressed, as shown by the double arrow B in FIG. 3.

The ram 16 preferably comprises a high pressure cylinder 40 and double acting piston 42 actuated by a built-in hydraulic or pneumatic system 44. Hydraulic or pneumatic rams for rescue operations or similar field work are known. Such rams are heavy duty, high force producing devices. They are conventionally supplied with an accompanying compressor or source of fluid or air under pressure. Such devices used by many police rescue teams are sold by the Hale Fire Pump Company, 700 Spring Mill Avenue, Conshohocken, Pa. 19428 under the trademark "HURST", Model Nos. JL-20A, JL-30A, and JL-60A.

Figure 4:
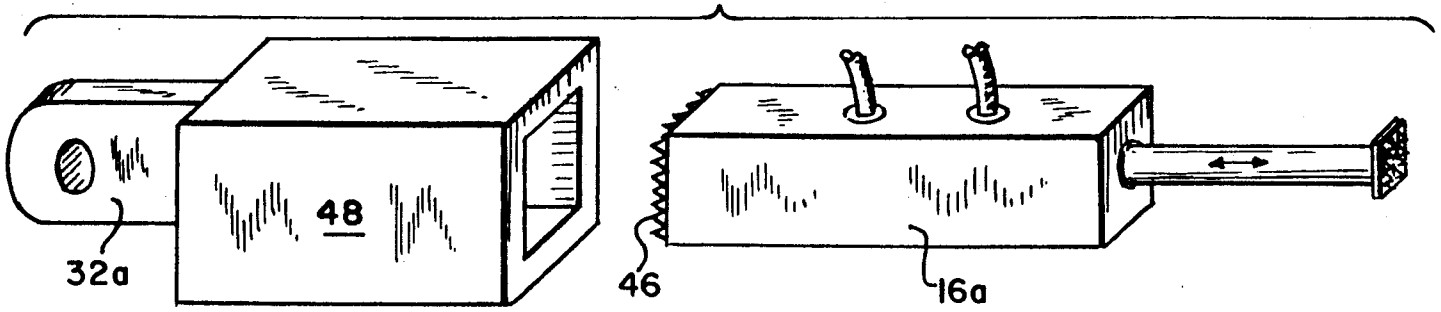
FIG. 4 is a view of a power ram and adaptor receiver for use in connecting the ram to the carriage.

Another commonly available ram 16*a* is illustrated in FIG. 4. In this latter case, no integral extending tongue is provided. Instead, the ram is made with a barbed rear wall 46 ostensibly to facilitate the seating of this ram against the cribbing or wooden blocks normally used to support it in use. Even this latter type of ram may be easily employed in the present invention. To do this, there is provided a cup-like receiver 48 adapted to slidingly fit securely and without play over the barbed rear wall 46. Extending integrally from the rear of the cup 48 is an eyelet tongue 32*a* similar to the tongue 32 previously described. Thus, a wide variety of rams can be easily connected to use with the present invention, where they are square, round, or otherwise shaped.

The carriage 22 is provided with a lock 50 for securing it in selected position upon outer tube 18. The lock 50 comprises a nut 52 welded to the outer surface of one side of carriage 24, into which a bolt 54 is threaded to pass through a hole 56 in the carriage. The hole 56 is located and sized so that the bolt 54 can be turned to bear against surface of the outer tube 18 on which the carriage slides. The bolt 54 is provided with a handle 58 slideably captive through the head of the bolt 54 in the same fashion as a vise handle, thus allowing for quick hand tightening of the lock without need for tools. A significant advantage of this type of lock is that carriage 22 may be fixed in any position along outer tube 12, allowing virtually infinite positioning of the extending ram.

The outer tube 18 is also provided with a similar lock 60 to secure the inner tube 14 in its selected extended position. The lock 60 is similar to that described for the carriage 18 and is also provided with a nut 62 welded to the outer tube 18 adjacent its open end. A bolt 64 having a handle 66 is likewise threaded through the nut 62 to extend through a hole the outer tube 18 to bear with considerable force against the surface of the inner tube 20. Because the inner tube 20 is concentrically, coaxially, and slideably nested within outer tube 18 and telescopically extendible therefrom, the length of base support 14 may be quickly and easily extended or reduced by selectively positioning the inner tube 20. Rearrangement of the base support even when sited in the collision is easily made by loosening the lock 60 and rearranging the inner tube 20. Other types of locking devices may be employed.

In some circumstances where the size, density, or rigidity of the counterstructure against which base support 14 is to be braced is insufficient or too weak to withstand the loads applied to it by the ram 16, it will be necessary to provide a wider footing to distribute the load. To effect this, the base support 14 is provided with one or more feet 70 having enlarged planar bottom surfaces 72. The feet 70 are built on a slidable sleeve 74 which conforms and fits over the outer tube 18, like the carriage 22. Thus, should the available supporting structure be soft or compliant such as upholstery, sand, or the like, the feet 70 are shifted and positioned on the base support to increase the supporting area or to abut a suitable fixed counterstructure.

Returning to FIG. 1, it will now be more easily seen how the apparatus of the present invention is placed in operation. On reaching the scene of the accident the operator readies the apparatus by loosely assembling, in collapsed condition, the inner and outer tubes, and placing the carriage and feet on the outer tube. The operator, of course, thereafter determines first the best counterstructure against which to brace the base support and secondly determines the best point against which to brace the piston for the greatest spreading effect. Unlike the prior art processes, it is not necessary that these points be located directly opposite each other or that the operator must contemplate numerous trial and error position. An advantage of the present invention lies in the fact that the base structure and the ram can be located at different levels and/or angles.

Thereafter the base support is placed in the vehicle adjacent the selected counterstructure and the inner tube extended to the most advantageous position and fixedly locked into place. Thereafter, the ram is hingedly attached to the clevis and the carriage moved along the outer tube into its preferred position and locked securely in place. Finally, the ram is elevated or depressed into a position where its piston bears against the steel structure to be spread. Should the apparatus require repositioning or readjustment, it may be simply made by releasing the locking devices and relocking it in the new position.

Operation of the ram itself will follow the conventional steps set forth by the manufacturer of the ram as to the application of pressurized media and for what time period etc. The operational loads of the ram will impose a significant load upon the base support. The feet, when used, will spread the counterload and prevent rotation of the base support from these loads or premature flexing of the counterstructure.

The adjustability of the carriage and likewise the feet longitudinally relative to the axis O or the initial positioning rotatively about the axis O allows the ram to be located in any selected and propitious direction from the base support. Further, the clevis hinge by which the ram 16 is attached to the base support 14 enables the ram to be placed even in the most inaccessible and difficult positions. Thus, the present apparatus retains its ability to forcibly and effectively exert its spreading action under virtually any condition.

it will thus be appreciated that the present invention provides those advantages and improvements noted in the introduction hereto. The apparatus is simple, flexible in use, highly maneuverable, and adaptable to many application. Above all, it has been found to enable the spreading of steel structures, particularly in automobile accidents, quicker and more effiectively so that fewer fatalities result from the trauma caused by delays in extricating accident victims.

While the above description contains many specificities, these should not be construed as limitations on the scope of the invention but rather as an exemplification of the preferred embodiment thereof. Accordingly, the scope of the instant invention should not be determined by the embodiment shown but rather by the claims appended hereto and their legal equivalents.

What is claimed is:

1. Apparatus for spreading opposing steel structures comprising a portable base support, a power ram, and means for slideably mounting said ram on said base support, said base support having an elongated outer tube and an elongated inner slide coaxially and slideably nested within said tube and being telescopically extendible therefrom to provide said base support with a longitudinally variable dimension for abuttment against one of said opposing structures, said means for mounting said power ram comprising a carriage disposed about the outer tube, said carriage being slideable on said outer tube along the longitudinal axis of said tube for abuttment against another of said opposing structures, said carriage having means for hingedly connecting said power ram to pivot in a plane transverse to said base support.

2. The apparatus as set forth in claim 1, wherein the cross sectional shapes of the slide and the outer tube are rectangular, and the fit between said slide and said outer tube is sufficiently close to prevent relative rotation of said slide and said tube about their coincidental longitudinal axis.

3. The apparatus as set forth in claim 2, including means for locking said carriage at selected positions along said outer tube.

4. The apparatus as set forth in claim 3, wherein said carriage has an aperature through the wall thereof and said lock means comprises a lock bolt and a mating lock nut, said lock nut being fastened to the wall of said carriage so that when said lock bolt is threaded into said lock nut, the tip of said lock bolt will pass through the wall aperture of said carriage and bear against said tube so that increased friction is created between said carriage and said tube.

5. The apparatus as set forth in claim 1, wherein said tube has lock means for securing the position of said inner slide with respect to said tube.

6. The apparatus as set forth in claim 5, wherein said outer tube has an aperture through the wall thereof near one end, and said lock means comprises a lock bolt and a mating lock nut, said lock nut being fastened to the wall of said tube so that when said lock bolt is threaded into said lock nut, the tip of said lock bolt will pass through the wall aperture of said tube and bear against said slide so that increased friction is created between said tube and said slide.

7. The apparatus as set forth in claim 1, wherein said means for mounting said ram comprises a clevis extending integral from said ram and said power ram having an aperture through its base, the aperture being oriented transversely to said power ram's axis of extension, and wherein said clevis has one or more ears extending laterally outward therefrom each said ear havng an aperture therethrough so that the apertures in said power ram and said ears can be aligned and pivotably and removably coupled together by installing said pin through the aligned apertures.

8. The apparatus as set forth in claim 1, further including one or more feet, each of said feet having an enlarged planar foot surface and means for removably coupling said foot to said base support.

9. Apparatus for separating structural parts of a vehicle comprising a portable elongated base support having a longitudinal axis, said base support being axially adjustable and adapted for abutment broadside against one of said structural parts and power means mounted thereon for slidable positioning along the length of said base support, said power means having a ram extending outwardly therefrom in a direction angular to the axis of said base support and being actuatable to forcibly abut against an opposing structural part counter to the central axis of said elongated base and pad means mounted on said support for adjustment along the length thereof for engaging the surface of said structural part.

* * * * *